US009837760B2

(12) United States Patent
Karagozler et al.

(10) Patent No.: US 9,837,760 B2
(45) Date of Patent: Dec. 5, 2017

(54) CONNECTORS FOR CONNECTING ELECTRONICS EMBEDDED IN GARMENTS TO EXTERNAL DEVICES

(71) Applicant: Google Inc., Mountain View, CA (US)

(72) Inventors: Mustafa Emre Karagozler, Mountain View, CA (US); Hakim Raja, San Francisco, CA (US); Ivan Poupyrev, Sunnyvale, CA (US); Youenn Colin, San Francisco, CA (US); Jimmy Chion, Oakland, CA (US); James R. Yurchenco, Palo Alto, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 15/343,067

(22) Filed: Nov. 3, 2016

(65) Prior Publication Data

US 2017/0125940 A1 May 4, 2017

Related U.S. Application Data

(60) Provisional application No. 62/250,937, filed on Nov. 4, 2015.

(51) Int. Cl.
*H01R 13/62* (2006.01)
*H01R 13/627* (2006.01)
(Continued)

(52) U.S. Cl.
CPC ..... *H01R 13/6205* (2013.01); *A41B 1/08* (2013.01); *A41D 1/002* (2013.01); *A42B 1/24* (2013.01);
(Continued)

(58) Field of Classification Search
CPC ..... H01R 13/62; H01R 13/70; H01R 13/24; H01R 12/79
(Continued)

(56) References Cited

U.S. PATENT DOCUMENTS 3,610,874 A 10/1971 Gagliano
3,953,706 A 4/1976 Harris et al.
(Continued)

FOREIGN PATENT DOCUMENTS

CN 202887794 4/2013
CN 103355860 1/2016
(Continued)

OTHER PUBLICATIONS

"Corrected Notice of Allowance", U.S. Appl. No. 14/504,061, dated Dec. 27, 2016, 2 pages.
(Continued)

*Primary Examiner* — Alexander Gilman
(74) *Attorney, Agent, or Firm* — Colby Nipper

(57) ABSTRACT

This document describes connectors for connecting electronics embedded in garments to external devices. The connector is configured to connect an external device to a garment to enable communication between electronics embedded in the garment and electronic components of the external device. The connector may include a connector plug and a connector receptacle. The connector plug may be implemented at the external device and is configured to connect to the connector receptacle, which may be implemented at the garment. In one or more implementations, the connector plug includes an anisotropic material that is configured to connect to a printed circuit board (PCB) implemented at the connector receptacle.

20 Claims, 4 Drawing Sheets

(51) Int. Cl.

| | |
|---|---|
| ***A41D 1/00*** | (2006.01) |
| ***A41B 1/08*** | (2006.01) |
| ***A42B 1/24*** | (2006.01) |
| ***H01R 12/59*** | (2011.01) |
| ***H01R 13/24*** | (2006.01) |
| ***H01R 39/64*** | (2006.01) |

(52) U.S. Cl.
CPC ..... *H01R 12/592* (2013.01); *H01R 13/24* (2013.01); *H01R 13/627* (2013.01); *H01R 39/64* (2013.01); *H01R 13/6277* (2013.01)

(58) Field of Classification Search
USPC ..... 439/37, 38, 39
See application file for complete search history.

(56) References Cited

U.S. PATENT DOCUMENTS 4,654,967 A 4/1987 Thenner
4,700,044 A 10/1987 Hokanson et al.
4,795,998 A 1/1989 Dunbar et al.
4,838,797 A * 6/1989 Dodier ..... H01F 38/14 439/38
5,298,715 A 3/1994 Chalco et al.
5,341,979 A 8/1994 Gupta
5,468,917 A * 11/1995 Brodsky ..... H01R 12/62 174/254
5,564,571 A 10/1996 Zanotti
5,656,798 A * 8/1997 Kubo ..... H01L 21/486 174/263
5,724,707 A * 3/1998 Kirk ..... A41D 13/0012 2/102
5,798,798 A 8/1998 Rector et al.
5,921,783 A * 7/1999 Fritsch ..... H01R 13/703 439/38
6,032,450 A 3/2000 Blum
6,080,690 A * 6/2000 Lebby ..... A41D 31/00 139/420 R
6,210,771 B1 4/2001 Post et al.
6,313,825 B1 11/2001 Gilbert
6,340,979 B1 1/2002 Beaton et al.
6,386,757 B1 5/2002 Konno
6,440,593 B2 * 8/2002 Ellison ..... B32B 27/20 428/294.1
6,492,980 B2 12/2002 Sandbach
6,493,933 B1 * 12/2002 Post ..... H01L 23/4985 257/E23.065
6,513,970 B1 2/2003 Tabata et al.
6,543,668 B1 4/2003 Fujii et al.
6,711,354 B2 * 3/2004 Kameyama ..... H01R 9/226 174/527
6,717,065 B2 * 4/2004 Hosaka ..... H01R 13/03 174/254
6,802,720 B2 * 10/2004 Weiss ..... H01R 13/2414 439/591
6,835,898 B2 12/2004 Eldridge et al.
6,854,985 B1 * 2/2005 Weiss ..... H01R 13/2414 439/591
6,929,484 B2 * 8/2005 Weiss ..... H01R 13/2421 439/66
7,134,879 B2 * 11/2006 Sugimoto ..... G02F 1/13452 252/512
7,223,105 B2 * 5/2007 Weiss ..... H01R 13/2414 439/497
7,249,954 B2 * 7/2007 Weiss ..... H01R 13/2414 439/66
7,299,964 B2 11/2007 Jayaraman et al.
7,310,236 B2 * 12/2007 Takahashi ..... H01B 1/24 348/E5.026
7,317,416 B2 1/2008 Flom et al.
7,348,285 B2 3/2008 Dhawan et al.
7,365,031 B2 4/2008 Swallow et al.
7,421,061 B2 9/2008 Boese et al.
7,462,035 B2 12/2008 Lee et al.
7,544,627 B2 6/2009 Tao et al.
7,578,195 B2 8/2009 DeAngelis et al.
7,644,488 B2 * 1/2010 Aisenbrey ..... C09K 5/14 29/602.1
7,670,144 B2 * 3/2010 Ito ..... H05K 1/0287 257/530
7,677,729 B2 3/2010 Vilser et al.
7,691,067 B2 4/2010 Westbrook et al.
7,698,154 B2 4/2010 Marchosky
7,791,700 B2 9/2010 Bellamy
7,834,276 B2 11/2010 Chou et al.
7,952,512 B1 5/2011 Delker et al.
8,062,220 B2 11/2011 Kurtz et al.
8,169,404 B1 5/2012 Boillot
8,179,604 B1 5/2012 Gomez et al.
8,282,232 B2 * 10/2012 Hsu ..... D03D 1/0088 362/103
8,289,185 B2 10/2012 Alonso
8,301,232 B2 10/2012 Albert et al.
8,308,489 B2 * 11/2012 Lee ..... H01R 13/2407 2/69
8,334,226 B2 12/2012 Nhan et al.
8,341,762 B2 * 1/2013 Balzano ..... A41D 1/005 2/102
8,367,942 B2 * 2/2013 Howell ..... D03D 1/0088 174/117 M
8,376,759 B2 * 2/2013 Debock ..... H01R 12/775 439/37
8,475,367 B1 7/2013 Yuen et al.
8,505,474 B2 8/2013 Kang et al.
8,549,829 B2 10/2013 Song et al.
8,560,972 B2 10/2013 Wilson
8,569,189 B2 * 10/2013 Bhattacharya ..... H05K 1/038 174/254
8,614,689 B2 * 12/2013 Nishikawa ..... G06F 3/045 178/18.05
8,700,137 B2 4/2014 Albert
8,758,020 B2 6/2014 Burdea et al.
8,759,713 B2 6/2014 Sheats
8,764,651 B2 7/2014 Tran
8,785,778 B2 * 7/2014 Streeter ..... A45F 5/00 174/72 A
8,790,257 B2 7/2014 Libbus et al.
8,814,574 B2 * 8/2014 Selby ..... H01R 4/4854 439/346
9,055,879 B2 * 6/2015 Selby ..... H01R 13/11
9,093,289 B2 * 7/2015 Vicard ..... D03D 1/0088
9,125,456 B2 9/2015 Chow
9,141,194 B1 9/2015 Keyes et al.
9,148,949 B2 * 9/2015 Zhou ..... H05K 1/038
9,230,160 B1 1/2016 Kanter
9,331,422 B2 * 5/2016 Nazzaro ..... H01R 13/44
9,335,825 B2 5/2016 Rautianinen et al.
9,575,560 B2 2/2017 Poupyrev et al.
9,588,625 B2 3/2017 Poupyrev
9,594,443 B2 3/2017 Vanblon et al.
9,600,080 B2 3/2017 Poupyrev
9,627,804 B2 * 4/2017 Barth ..... H01R 13/627
9,693,592 B2 7/2017 Robinson et al.
9,778,749 B2 10/2017 Poupyrev
2002/0080156 A1 6/2002 Abbott et al.
2002/0170897 A1 11/2002 Hall
2003/0100228 A1 5/2003 Bungo et al.
2003/0119391 A1 6/2003 Swallow et al.
2004/0009729 A1 1/2004 Hill et al.
2004/0259391 A1 12/2004 Jung et al.
2005/0069695 A1 3/2005 Jung et al.
2005/0148876 A1 7/2005 Endoh et al.
2006/0035554 A1 2/2006 Glaser et al.
2006/0040739 A1 2/2006 Wells
2006/0157734 A1 7/2006 Onodero et al.
2006/0166620 A1 7/2006 Sorensen
2006/0258205 A1 11/2006 Locher et al.
2007/0026695 A1 * 2/2007 Lee ..... H01R 12/592 439/37
2007/0118043 A1 5/2007 Oliver et al.
2007/0161921 A1 7/2007 Rausch

(56) References Cited

U.S. PATENT DOCUMENTS

2007/0176821 A1 8/2007 Flom et al.
2007/0177298 A1* 8/2007 Jaatinen ..... A61B 5/0408 360/123.56
2007/0192647 A1 8/2007 Glaser
2007/0197878 A1 8/2007 Shklarski
2007/0210074 A1 9/2007 Maurer et al.
2008/0002027 A1 1/2008 Kondo et al.
2008/0024438 A1 1/2008 Collins et al.
2008/0065291 A1 3/2008 Breed
2008/0134102 A1 6/2008 Movold et al.
2008/0136775 A1 6/2008 Conant
2008/0168396 A1 7/2008 Matas et al.
2008/0211766 A1 9/2008 Westerman et al.
2008/0233822 A1* 9/2008 Swallow ..... D03D 1/0088 442/185
2008/0282665 A1* 11/2008 Speleers ..... D02G 3/12 57/212
2008/0291158 A1 11/2008 Park et al.
2008/0303800 A1 12/2008 Elwell
2008/0316085 A1 12/2008 Rofougaran et al.
2008/0320419 A1 12/2008 Matas et al.
2009/0033585 A1 2/2009 Lang
2009/0053950 A1* 2/2009 Surve ..... C23C 4/04 442/181
2009/0056300 A1 3/2009 Chung et al.
2009/0113298 A1 4/2009 Jung et al.
2009/0115617 A1 5/2009 Sano et al.
2009/0118648 A1 5/2009 Kandori et al.
2009/0149036 A1 6/2009 Lee et al.
2009/0177068 A1 7/2009 Stivoric et al.
2009/0203244 A1 8/2009 Toonder
2009/0270690 A1 10/2009 Roos et al.
2009/0288762 A1 11/2009 Wolfel
2009/0295712 A1 12/2009 Ritzau
2010/0065320 A1 3/2010 Urano
2010/0071205 A1* 3/2010 Graumann ..... D03D 1/0088 29/825
2010/0094141 A1 4/2010 Puswella
2010/0201586 A1 8/2010 Michalk
2010/0205667 A1 8/2010 Anderson et al.
2010/0208035 A1 8/2010 Pinault et al.
2010/0225562 A1 9/2010 Smith
2010/0241009 A1 9/2010 Petkie
2010/0281438 A1 11/2010 Latta et al.
2010/0306713 A1 12/2010 Geisner et al.
2010/0313414 A1* 12/2010 Sheats ..... B23K 20/004 29/829
2010/0325770 A1 12/2010 Chung et al.
2011/0003664 A1 1/2011 Richard
2011/0010014 A1 1/2011 Oexman et al.
2011/0073353 A1* 3/2011 Lee ..... D03D 1/0088 174/254
2011/0093820 A1 4/2011 Zhang et al.
2011/0159705 A1* 6/2011 Schmidt ..... H01R 11/30 439/39
2011/0181509 A1 7/2011 Rautiainen et al.
2011/0181510 A1 7/2011 Hakala et al.
2011/0197263 A1 8/2011 Stinson, III
2011/0213218 A1 9/2011 Weiner et al.
2011/0221666 A1 9/2011 Newton et al.
2011/0234492 A1 9/2011 Ajmera et al.
2011/0279303 A1 11/2011 Smith
2011/0303341 A1* 12/2011 Meiss ..... B23K 20/004 156/51
2011/0307842 A1 12/2011 Chiang et al.
2011/0318985 A1 12/2011 McDermid
2012/0019168 A1 1/2012 Noda et al.
2012/0047468 A1 2/2012 Santos et al.
2012/0068876 A1 3/2012 Bangera et al.
2012/0092284 A1 4/2012 Rofougaran et al.
2012/0123232 A1 5/2012 Najarian et al.
2012/0127082 A1 5/2012 Kushler et al.
2012/0144934 A1 6/2012 Russell et al.
2012/0156926 A1* 6/2012 Kato ..... H05B 3/342 439/502
2012/0174299 A1 7/2012 Balzano
2012/0174736 A1 7/2012 Wang et al.
2012/0193801 A1 8/2012 Gross et al.
2012/0248093 A1 10/2012 Ulrich et al.
2012/0254810 A1 10/2012 Heck et al.
2012/0268416 A1 10/2012 Pirogov et al.
2012/0280900 A1 11/2012 Wang et al.
2012/0310665 A1 12/2012 Xu et al.
2013/0016070 A1 1/2013 Starner et al.
2013/0046544 A1 2/2013 Kay et al.
2013/0053653 A1 2/2013 Cuddihy et al.
2013/0082922 A1 4/2013 Miller
2013/0083173 A1 4/2013 Geisner et al.
2013/0102217 A1* 4/2013 Jeon ..... D03D 15/0027 442/182
2013/0104084 A1 4/2013 Mlyniec et al.
2013/0132931 A1 5/2013 Bruns et al.
2013/0150735 A1 6/2013 Cheng
2013/0161078 A1 6/2013 Li
2013/0194173 A1 8/2013 Zhu et al.
2013/0195330 A1 8/2013 Kim et al.
2013/0196716 A1 8/2013 Muhammad
2013/0207962 A1 8/2013 Oberdorfer et al.
2013/0278499 A1 10/2013 Anderson
2013/0278501 A1 10/2013 Bulzacki
2013/0332438 A1 12/2013 Li et al.
2013/0345569 A1 12/2013 Mestha et al.
2014/0005809 A1 1/2014 Frei et al.
2014/0049487 A1 2/2014 Konertz et al.
2014/0070957 A1 3/2014 Longinotti-Buitoni
2014/0073969 A1 3/2014 Zou et al.
2014/0081100 A1* 3/2014 Muhsin ..... A61B 5/0002 600/324
2014/0095480 A1 4/2014 Marantz et al.
2014/0121540 A1 5/2014 Raskin
2014/0135631 A1 5/2014 Brumback et al.
2014/0139422 A1 5/2014 Mistry et al.
2014/0139616 A1 5/2014 Pinter et al.
2014/0143678 A1 5/2014 Mistry et al.
2014/0184496 A1 7/2014 Gribetz et al.
2014/0191939 A1 7/2014 Penn et al.
2014/0200416 A1 7/2014 Kashef et al.
2014/0208275 A1 7/2014 Mongia et al.
2014/0215389 A1 7/2014 Walsh et al.
2014/0239065 A1 8/2014 Zhou et al.
2014/0244277 A1 8/2014 Krishna Rao et al.
2014/0246415 A1 9/2014 Wittkowski
2014/0250515 A1 9/2014 Jakobsson
2014/0253431 A1 9/2014 Gossweiler et al.
2014/0253709 A1 9/2014 Bresch et al.
2014/0262478 A1 9/2014 Harris et al.
2014/0280295 A1 9/2014 Kurochikin et al.
2014/0281975 A1 9/2014 Anderson
2014/0297006 A1 10/2014 Sadhu
2014/0306936 A1 10/2014 Dahl et al.
2014/0316261 A1 10/2014 Lux et al.
2014/0318699 A1 10/2014 Longinotti-Buitoni et al.
2014/0324888 A1 10/2014 Xie et al.
2014/0347295 A1 11/2014 Kim et al.
2014/0357369 A1 12/2014 Callens et al.
2015/0002391 A1 1/2015 Chen
2015/0009096 A1 1/2015 Lee et al.
2015/0029050 A1 1/2015 Driscoll et al.
2015/0040040 A1 2/2015 Balan et al.
2015/0068069 A1 3/2015 Tran et al.
2015/0077282 A1 3/2015 Mohamadi
2015/0085060 A1 3/2015 Fish et al.
2015/0091858 A1 4/2015 Rosenberg et al.
2015/0112606 A1 4/2015 He et al.
2015/0133017 A1 5/2015 Liao et al.
2015/0145805 A1 5/2015 Liu
2015/0162729 A1 6/2015 Reversat et al.
2015/0199045 A1 7/2015 Robucci et al.
2015/0261320 A1 9/2015 Leto
2015/0268027 A1 9/2015 Gerdes
2015/0268799 A1 9/2015 Starner et al.
2015/0277569 A1 10/2015 Sprenger et al.

(56) References Cited

U.S. PATENT DOCUMENTS

| | | | | |
|---|---|---|---|---|
| 2015/0280102 | A1 | 10/2015 | Tajitsu et al. | |
| 2015/0312041 | A1 | 10/2015 | Choi | |
| 2015/0332075 | A1* | 11/2015 | Burch | G06K 7/10821 345/156 |
| 2015/0346820 | A1 | 12/2015 | Poupyrev et al. | |
| 2015/0375339 | A1 | 12/2015 | Sterling et al. | |
| 2016/0018948 | A1 | 1/2016 | Parvarandeh et al. | |
| 2016/0026253 | A1 | 1/2016 | Bradski et al. | |
| 2016/0038083 | A1 | 2/2016 | Ding et al. | |
| 2016/0040825 | A1* | 2/2016 | Franklin | F16M 13/02 439/39 |
| 2016/0041617 | A1 | 2/2016 | Poupyrev | |
| 2016/0041618 | A1 | 2/2016 | Poupyrev | |
| 2016/0048235 | A1 | 2/2016 | Poupyrev | |
| 2016/0048236 | A1 | 2/2016 | Poupyrev | |
| 2016/0054792 | A1 | 2/2016 | Poupyrev | |
| 2016/0054803 | A1 | 2/2016 | Poupyrev | |
| 2016/0054804 | A1 | 2/2016 | Gollakata et al. | |
| 2016/0055201 | A1 | 2/2016 | Poupyrev et al. | |
| 2016/0098089 | A1 | 4/2016 | Poupyrev | |
| 2016/0100166 | A1 | 4/2016 | Dragne et al. | |
| 2016/0103500 | A1 | 4/2016 | Hussey et al. | |
| 2016/0106328 | A1 | 4/2016 | Mestha et al. | |
| 2016/0145776 | A1 | 5/2016 | Roh | |
| 2016/0216825 | A1 | 7/2016 | Forutanpour | |
| 2016/0249698 | A1 | 9/2016 | Berzowska et al. | |
| 2016/0259037 | A1 | 9/2016 | Molchanov et al. | |
| 2016/0282988 | A1* | 9/2016 | Poupyrev | D03D 1/0088 |
| 2016/0283101 | A1* | 9/2016 | Schwesig | A41D 1/002 |
| 2016/0284436 | A1 | 9/2016 | Fukuhara et al. | |
| 2016/0299526 | A1 | 10/2016 | Inagaki et al. | |
| 2016/0320852 | A1 | 11/2016 | Poupyrev | |
| 2016/0320853 | A1 | 11/2016 | Lien et al. | |
| 2016/0320854 | A1 | 11/2016 | Lien et al. | |
| 2016/0345638 | A1* | 12/2016 | Robinson | A41D 1/005 |
| 2016/0349790 | A1 | 12/2016 | Connor | |
| 2016/0349845 | A1 | 12/2016 | Poupyrev et al. | |
| 2017/0097413 | A1 | 4/2017 | Gillian et al. | |
| 2017/0097684 | A1 | 4/2017 | Lien | |
| 2017/0115777 | A1 | 4/2017 | Poupyrev | |
| 2017/0125940 | A1* | 5/2017 | Karagozler | H01R 13/6205 |
| 2017/0232538 | A1 | 8/2017 | Robinson et al. | |

FOREIGN PATENT DOCUMENTS

| | | |
|---|---|---|
| DE | 102011075725 | 11/2012 |
| DE | 102013201359 | 7/2014 |
| EP | 0161895 | 11/1985 |
| EP | 1815788 | 8/2007 |
| GB | 2070469 | 9/1981 |
| GB | 2443208 | 4/2008 |
| JP | 2006234716 | 9/2006 |
| JP | 2011102457 | 5/2011 |
| WO | WO-0127855 | 4/2001 |
| WO | WO-0130123 | 4/2001 |
| WO | WO 0175778 | 10/2001 |
| WO | WO-02082999 | 10/2002 |
| WO | WO-2005033387 | 4/2005 |
| WO | 2007125298 | 11/2007 |
| WO | WO-2008061385 | 5/2008 |
| WO | WO-2009032073 | 3/2009 |
| WO | WO-2010032173 | 3/2010 |
| WO | WO-2012026013 | 3/2012 |
| WO | WO-2012152476 | 11/2012 |
| WO | WO-2013082806 | 6/2013 |
| WO | WO-2013084108 | 6/2013 |
| WO | WO-2013186696 | 12/2013 |
| WO | WO-2013191657 | 12/2013 |
| WO | WO-2014019085 | 2/2014 |
| WO | WO-2014116968 | 7/2014 |
| WO | WO-2014136027 | 9/2014 |
| WO | WO-2014138280 | 9/2014 |
| WO | WO-2014160893 | 10/2014 |
| WO | WO-2014165476 | 10/2014 |
| WO | WO-2014204323 | 12/2014 |
| WO | WO-2015017931 | 2/2015 |
| WO | WO-2015022671 | 2/2015 |
| WO | 2016053624 | 4/2016 |

OTHER PUBLICATIONS

"Corrected Notice of Allowance", U.S. Appl. No. 14/582,896, dated Dec. 19, 2016, 2 pages.

"International Search Report and Written Opinion", Application No. PCT/US2016/024289, dated Aug. 25, 2016, 17 pages.

"Notice of Allowance", U.S. Appl. No. 14/582,896, dated Nov. 7, 2016, 5 pages.

Cheng,"Smart Textiles: From Niche to Mainstream", IEEE Pervasive Computing, Jul. 2013, pp. 81-84.

Farringdon,"Wearable Sensor Badge & Sensor Jacket for Context Awareness", Third International Symposium on Wearable Computers, Oct. 1999, 7 pages.

Schneegass,"Towards a Garment OS: Supporting Application Development for Smart Garments", Wearable Computers, ACM, Sep. 2014, 6 pages.

"Cardiio", Retrieved From: <http://www.cardiio.com/> Apr. 15, 2015 App Information Retrieved From: <https://itunes.apple.com/us/app/cardiio-touchless-camera-pulse/id542891434?ls=1&mt=8> Apr. 15, 2015, Feb. 24, 2015, 6 pages.

"Corrected Notice of Allowance", U.S. Appl. No. 14/312,486, dated Oct. 28, 2016, 4 pages.

"Extended European Search Report", EP Application No. 15170577.9, dated Nov. 5, 2015, 12 pages.

"Final Office Action", U.S. Appl. No. 14/312,486, dated Jun. 3, 2016, 32 pages.

"Final Office Action", U.S. Appl. No. 14/504,038, dated Sep. 27, 2016, 23 pages.

"Final Office Action", U.S. Appl. No. 14/504,061, dated Mar. 9, 2016, 10 pages.

"Frogpad Introduces Wearable Fabric Keyboard with Bluetooth Technology", Retrieved From: <http://www.geekzone.co.nz/content.asp?contentid=3898> Mar. 16, 2015, Jan. 7, 2005, 2 pages.

"International Search Report and Written Opinion", Application No. PCT/US2015/044774, dated Nov. 3, 2015, 12 pages.

"International Search Report and Written Opinion", Application No. PCT/US2016/024267, dated Jun. 20, 2016, 13 pages.

"International Search Report and Written Opinion", Application No. PCT/US2016/024273, dated Jun. 20, 2016, 13 pages.

"International Search Report and Written Opinion", Application No. PCT/US2016/032307, dated Aug. 25, 2016, 13 pages.

"International Search Report and Written Opinion", Application No. PCT/US2016/029820, dated Jul. 15, 2016, 14 pages.

"International Search Report and Written Opinion", Application No. PCT/US2016/030177, dated Aug. 2, 2016, 15 pages.

"International Search Report and Written Opinion", Application No. PCT/US2015/043963, dated Nov. 24, 2015, 16 pages.

"International Search Report and Written Opinion", Application No. PCT/US2015/050903, dated Feb. 19, 2016, 18 pages.

"International Search Report and Written Opinion", Application No. PCT/US2016/030115, dated Aug. 8, 2016, 18 pages.

"International Search Report and Written Opinion", Application No. PCT/US2015/043949, dated Dec. 1, 2015, 18 pages.

"Non-Final Office Action", U.S. Appl. No. 14/312,486, dated Oct. 23, 2015, 25 pages.

"Non-Final Office Action", U.S. Appl. No. 14/504,038, dated Feb. 26, 2016, 22 pages.

"Non-Final Office Action", U.S. Appl. No. 14/504,061, dated Nov. 4, 2015, 8 pages.

"Non-Final Office Action", U.S. Appl. No. 14/518,863, dated Oct. 14, 2016, 16 pages.

"Non-Final Office Action", U.S. Appl. No. 14/582,896, dated Jun. 29, 2016, 9 pages.

"Non-Final Office Action", U.S. Appl. No. 14/666,155, dated Aug. 24, 2016, 9 pages.

"Non-Final Office Action", U.S. Appl. No. 14/681,625, dated Aug. 12, 2016, 9 pages.

(56) References Cited

OTHER PUBLICATIONS

"Non-Final Office Action", U.S. Appl. No. 14/930,220, dated Sep. 14, 2016, 15 pages.
"Notice of Allowance", U.S. Appl. No. 14/312,486, dated Oct. 7, 2016, 15 pages.
"Notice of Allowance", U.S. Appl. No. 14/504,061, dated Sep. 12, 2016, 7 pages.
"Philips Vital Signs Camera", Retrieved From: <http://www.vitalsignscamera.com/> Apr. 15, 2015, Jul. 17, 2013, 2 pages.
"Pre-Interview Communication", U.S. Appl. No. 14/513,875, dated Oct. 21, 2016, 3 pages.
"Restriction Requirement", U.S. Appl. No. 14/666,155, dated Jul. 22, 2016, 5 pages.
"The Instant Blood Pressure app estimates blood pressure with your smartphone and our algorithm", Retrieved at: http://www.instantbloodpressure.com/—on Jun. 23, 2016, 6 pages.
Arbabian,"A 94GHz mm-Wave to Baseband Pulsed-Radar for Imaging and Gesture Recognition", 2012 IEEE, 2012 Symposium on VLSI Circuits Digest of Technical Papers, 2012, 2 pages.
Balakrishnan,"Detecting Pulse from Head Motions in Video", In Proceedings: CVPR '13 Proceedings of the 2013 IEEE Conference on Computer Vision and Pattern Recognition Available at: <http://people.csail.mit.edu/mrub/vidmag/papers/Balakrishnan_Detecting_Pulse_from_2013_CVPR_paper.pdf>, Jun. 23, 2013, 8 pages.
Couderc,"Detection of Atrial Fibrillation using Contactless Facial Video Monitoring", In Proceedings: Heart Rhythm Society, vol. 12, Issue 1 Available at: <http://www.heartrhythmjournal.com/article/S1547-5271(14)00924-2/pdf>, Jan. 2015, 7 pages.
Espina,"Wireless Body Sensor Network for Continuous Cuff-less Blood Pressure Monitoring", International Summer School on Medical Devices and Biosensors, 2006, Sep. 2006, 5 pages.
Godana,"Human Movement Characterization in Indoor Environment using GNU Radio Based Radar", Retrieved at: http://repository.tudelft.nl/islandora/object/uuid:414e1868-dd00-4113-9989-4c213f1f7094?collection=education, Nov. 30, 2009, 100 pages.
He,"A Continuous, Wearable, and Wireless Heart Monitor Using Head Ballistocardiogram (BCG) and Head Electrocardiogram (ECG) with a Nanowatt ECG Heartbeat Detection Circuit", In Proceedings: Thesis, Department of Electrical Engineering and Computer Science, Massachusetts Institute of Technology Available at: <http://dspace.mit.edu/handle/1721.1/79221>, Feb. 2013, 137 pages.
Holleis,"Evaluating Capacitive Touch Input on Clothes", Proceedings of the 10th International Conference on Human Computer Interaction, Jan. 1, 2008, 10 pages.
Nakajima,"Development of Real-Time Image Sequence Analysis for Evaluating Posture Change and Respiratory Rate of a Subject in Bed", In Proceedings: Physiological Measurement, vol. 22, No. 3 Retrieved From: <http://iopscience.iop.org/0967-3334/22/3/401/pdf/0967-3334_22_3_401.pdf> Feb. 27, 2015, Aug. 2001, 8 pages.
Patel,"Applications of Electrically Conductive Yarns in Technical Textiles", International Conference on Power System Technology (POWECON), Oct. 30, 2012, 6 pages.
Poh,"A Medical Mirror for Non-contact Health Monitoring", In Proceedings: ACM SIGGRAPH Emerging Technologies Available at: <http://affect.media.mit.edu/pdfs/11.Poh-etal-SIGGRAPH.pdf>, 2011, 1 page.
Poh,"Non-contact, Automated Cardiac Pulse Measurements Using Video Imaging and Blind Source Separation.", In Proceedings: Optics Express, vol. 18, No. 10 Available at: <http://www.opticsinfobase.org/view_article.cfm?gotourl=http%3A%2F%2Fwww%2Eopticsinfobase%2Eorg%2FDirectPDFAccess%2F77B04D55%2DBC95%2D6937%2 D5BAC49A426378C02%5F199381%2Foe%2D18%2D10%2D10762%2Ep, May 7, 2010, 13 pages.
Pu,"Gesture Recognition Using Wireless Signals", Oct. 2014, pp. 15-18.
Pu,"Whole-Home Gesture Recognition Using Wireless Signals", MobiCom '13 Proceedings of the 19th annual international conference on Mobile computing & networking, Aug. 27, 2013, 12 pages.
Wang,"Exploiting Spatial Redundancy of Image Sensor for Motion Robust rPPG", In Proceedings: IEEE Transactions on Biomedical Engineering, vol. 62, Issue 2, Jan. 19, 2015, 11 pages.
Wang,"Micro-Doppler Signatures for Intelligent Human Gait Recognition Using a UWB Impulse Radar", 2011 IEEE International Symposium on Antennas and Propagation (APSURSI), Jul. 3, 2011, pp. 2103-2106.
Wijesiriwardana,"Capacitive Fibre-Meshed Transducer for Touch & Proximity Sensing Applications", IEEE Sensors Journal, IEEE Service Center, Oct. 1, 2005, 5 pages.
Zhadobov,"Millimeter-wave Interactions with the Human Body: State of Knowledge and Recent Advances", International Journal of Microwave and Wireless Technologies, Mar. 1, 2011, 11 pages.
Zhang,"Study of the Structural Design and Capacitance Characteristics of Fabric Sensor", Advanced Materials Research (vols. 194-196), Feb. 21, 2011, 8 pages.
"Corrected Notice of Allowance", U.S. Appl. No. 14/312,486, dated Jan. 23, 2017, 4 pages.
"Corrected Notice of Allowance", U.S. Appl. No. 14/582,896, dated Feb. 6, 2017, 2 pages.
"Corrected Notice of Allowance", U.S. Appl. No. 14/582,896, dated Feb. 23, 2017, 2 pages.
"International Preliminary Report on Patentability", Application No. PCT/US2015/043963, dated Feb. 16, 2017, 12 pages.
"International Preliminary Report on Patentability", Application No. PCT/US2015/030388, dated Dec. 15, 2016, 12 pages.
"International Preliminary Report on Patentability", Application No. PCT/US2015/043949, dated Feb. 16, 2017, 13 pages.
"International Preliminary Report on Patentability", Application No. PCT/US2015/044774, dated Mar. 2, 2017, 8 pages.
"International Search Report and Written Opinion", Application No. PCT/US2016/062082, dated Feb. 23, 2017, 12 pages.
"International Search Report and Written Opinion", Application No. PCT/US2016/055671, dated Dec. 1, 2016, 14 pages.
"Non-Final Office Action", U.S. Appl. No. 14/504,121, dated Jan. 9, 2017, 13 pages.
"Non-Final Office Action", U.S. Appl. No. 14/504,139, dated Jan. 27, 2017, 10 pages.
"Non-Final Office Action", U.S. Appl. No. 14/513,875, dated Feb. 21, 2017, 9 pages.
"Non-Final Office Action", U.S. Appl. No. 14/874,955, dated Feb. 27, 2017, 8 pages.
"Non-Final Office Action", U.S. Appl. No. 14/959,799, dated Jan. 27, 2017, 10 pages.
"Notice of Allowance", U.S. Appl. No. 14/930,220, dated Feb. 2, 2017, 8 pages.
"Pre-Interview Communication", U.S. Appl. No. 14/494,863, dated Jan. 27, 2017, 5 pages.
"Pre-Interview Communication", U.S. Appl. No. 14/959,730, dated Feb. 15, 2017, 3 pages.
"Pre-Interview Communication", U.S. Appl. No. 14/959,901, dated Feb. 10, 2017, 3 pages.
"Combined Search and Examination Report", GB Application No. 1620892.8, dated Apr. 6, 2017, 5 pages.
"Corrected Notice of Allowance", U.S. Appl. No. 14/930,220, dated Mar. 20, 2017, 2 pages.
"First Action Interview Office Action", U.S. Appl. No. 14/959,901, dated Apr. 14, 2017, 3 pages.
"International Search Report and Written Opinion", Application No. PCT/US2016/060399, dated Jan. 30, 2017, 11 pages.
"Non-Final Office Action", U.S. Appl. No. 14/504,038, dated Mar. 22, 2017, 33 pages.
"Non-Final Office Action", U.S. Appl. No. 15/398,147, dated Mar. 9, 2017, 10 pages.
"Textile Wire Brochure", Retrieved at: http://www.textile-wire.ch/en/home.html, Aug. 7, 2004, 17 pages.
Stoppa,"Wearable Electronics and Smart Textiles: A Critical Review", In Proceedings of Sensors, vol. 14, Issue 7, Jul. 7, 2014, pp. 11957-11992.

(56) References Cited

OTHER PUBLICATIONS

"Combined Search and Examination Report", GB Application No. 1620891.0, May 31, 2017, 9 pages.
"Corrected Notice of Allowance", U.S. Appl. No. 14/930,220, May 11, 2017, 2 pages.
"Final Office Action", U.S. Appl. No. 14/959,799, Jul. 7, 2017, 12 pages.
"Final Office Action", U.S. Appl. No. 14/518,863, May 5, 2017, 18 pages.
"International Search Report and Written Opinion", Application No. PCT/US2016/063874, May 11, 2017, 19 pages.
"Non-Final Office Action", U.S. Appl. No. 15/403,066, May 4, 2017, 31 pages.
"Notice of Allowance", U.S. Appl. No. 14/494,863, May 30, 2017, 7 pages.
"Advisory Action", U.S. Appl. No. 14/504,139, Aug. 28, 2017, 3 pages.
"Final Office Action", U.S. Appl. No. 15/398,147, Jun. 30, 2017, 11 pages.
"Final Office Action", U.S. Appl. No. 14/874,955, Jun. 30, 2017, 9 pages.
"Final Office Action", U.S. Appl. No. 14/504,121, Aug. 8,2017, 16 pages.
"Final Office Action", U.S. Appl. No. 14/959,901, Aug. 25, 2017, 19 pages.
"Non-Final Office Action", U.S. Appl. No. 14/862,409, Jun. 22, 2017, 15 pages.
"Non-Final Office Action", U.S. Appl. No. 14/959,730, Jun. 23, 2017, 14 pages.
"Non-Final Office Action", U.S. Appl. No. 15/093,533, Aug. 24, 2017, 18 pages.
"Non-Final Office Action", U.S. Appl. No. 15/142,619, Aug. 25, 2017, 16 pages.
"Non-Final Office Action", U.S. Appl. No. 14/959,799, Sep. 8, 2017, 16 pages.
"Non-Final Office Action", U.S. Appl. No. 15/398,147, Sep. 8, 2017, 7 pages.
"Notice of Allowance", U.S. Appl. No. 14/513,875, Jun. 28, 2017, 7 pages.
"Notice of Allowance", U.S. Appl. No. 14/504,038, Aug. 7, 2017, 17 pages.
"Pre-Interview Office Action", U.S. Appl. No. 14/862,409, Sep. 15, 2017, 16 pages.
"Final Office Action", U.S. Appl. No. 15/403,066, Oct. 5, 2017, 31 pages.
"Non-Final Office Action", U.S. Appl. No. 14/518,863, Sep. 29, 2017, 20 pages.
"Non-Final Office Action", U.S. Appl. No. 15/142,689, Oct. 4, 2017, 18 pages.
"Non-Final Office Action", U.S. Appl. No. 14/504,139, Oct. 18, 2017, 12 pages.
"Notice of Allowance", U.S. Appl. No. 14/874,955, Oct. 20, 2017, 7 pages.
"Written Opinion", PCT Application No. PCT/US2017/032733, Jul. 26, 2017, 5 pages.

* cited by examiner

CONNECTORS FOR CONNECTING ELECTRONICS EMBEDDED IN GARMENTS TO EXTERNAL DEVICES

RELATED APPLICATIONS

This application claims priority under 35 U.S.C. Section 119(e) to U.S. Provisional Application No. 62/250,937 entitled "Connectors for Connecting Electronics Embedded in Garments to External Devices" and filed Nov. 4, 2015, the disclosure of which is incorporated by reference herein in its entirety.

BACKGROUND

Electronics embedded in garments are becoming increasingly common, and such electronics often need connectivity to external devices for power and/or data transmission. Conventional connectors do not provides such connectivity, while at the same time providing multi-pin electrical connections and power transmission simultaneously, being washable and cleanable, being easily engaged and disengaged by the user, remaining locked when desired, being forgiving to rotation misalignments, and/or being easily integrated into fabrics.

SUMMARY

This document describes connectors for connecting electronics embedded in garments to external devices. The connector is configured to connect an external device to a garment to enable communication between electronics embedded in the garment and electronic components of the external device. The connector may include a connector plug and a connector receptacle. The connector plug may be implemented at the external device and is configured to connect to the connector receptacle, which may be implemented at the garment.

The connector plug may utilize a variety of different materials to form an electrical connection with the connector receptacle. In one or more implementations, the connector plug includes an anisotropic material that is configured to connect to a printed circuit board (PCB) implemented at the connector receptacle. For example, the connector plug, implemented at the external device, may include a first printed circuit board coupled to a strip of an anisotropic conducting polymer. The connector receptacle, implemented at the garment, may include a second printed circuit board that includes circular pads. The strip of anisotropic conducting polymer is configured to form a connection with the circular pads of the second printed circuit board to enable a connection between one or more electronic components of the external device and the electronics embedded in the garment.

In another implementation, the connector plug may include compliant polyurethane polymers to provide compliance to metal pads implemented at the connector receptacle to enable an electromagnetic connection. In another implementation, the connector plug and the connector receptacle may each include magnetically coupled coils which can be aligned to provide power and data transmission between the garment and the external device.

This summary is provided to introduce simplified concepts concerning connectors for connecting electronics embedded in garments to external devices, which is further described below in the Detailed Description. This summary is not intended to identify essential features of the claimed subject matter, nor is it intended for use in determining the scope of the claimed subject matter.

BRIEF DESCRIPTION OF THE DRAWINGS

Embodiments of connectors for connecting electronics embedded in garments to external devices are described with reference to the following drawings. The same numbers are used throughout the drawings to reference like features and components.

DETAILED DESCRIPTION

Overview

Figure 1:
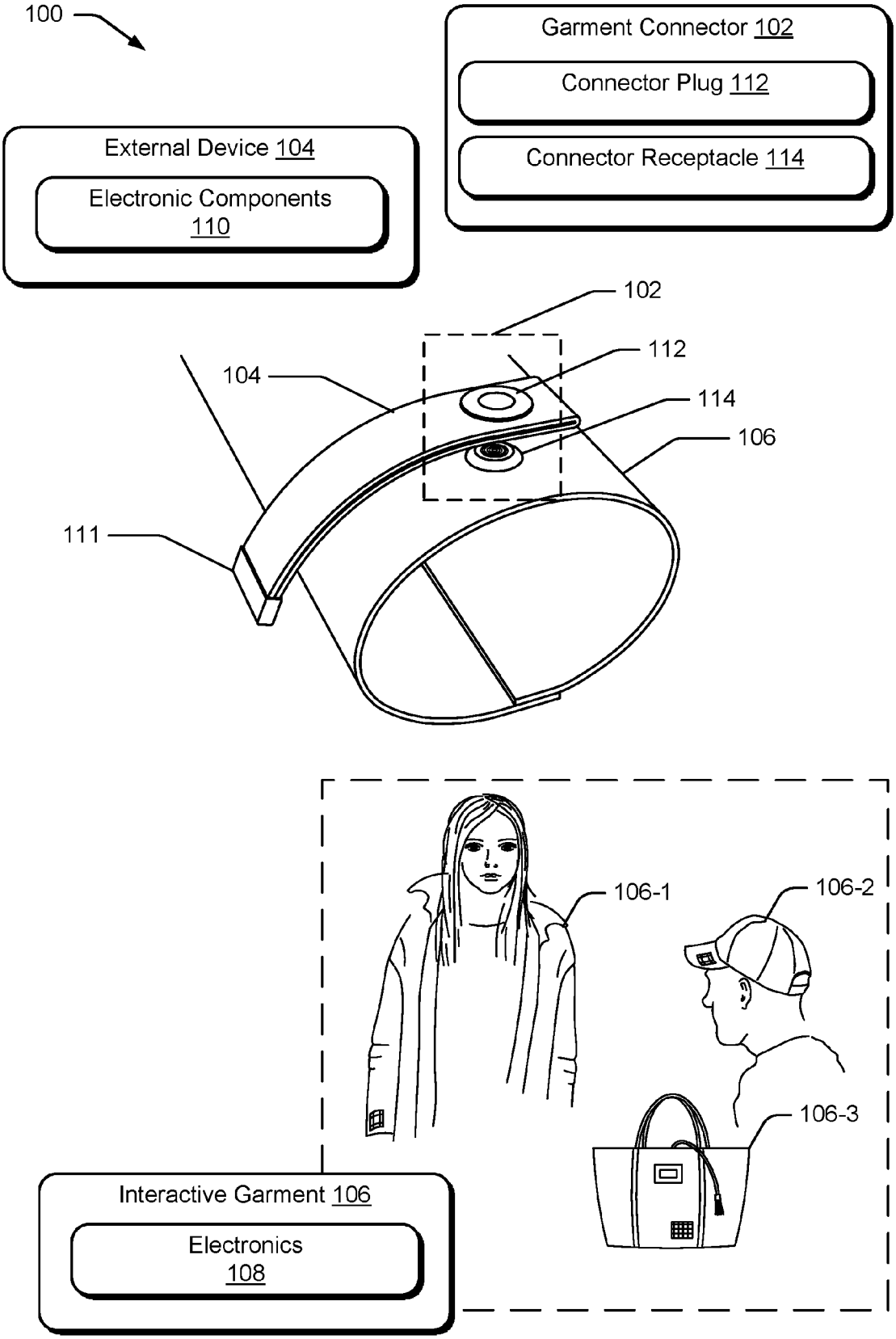
FIG. 1 is an illustration of an example environment in which a connector for connecting electronics embedded in garments to external devices can be implemented.

Electronics embedded in garments are becoming increasingly common. Such electronics often need connectivity to external devices for power and/or data transmission. For example, it can be difficult to integrate bulky electronic components (e.g., such as batteries, microprocessors, wireless units, and sensors) into wearable garments, such as a shirt, coat, or pair of pants. Furthermore, connecting such electronic components to a garment may cause issues with durability since garments are often washed. Thus, instead of integrating such electronic components within the garment, at least some of the electronic components may be placed in an external device. When electronic components are placed in an external device, a connector may be utilized to connect the electronic components in the external device to the electronics embedded in the garment.

Connectors for connecting electronics embedded in garments to external devices are described. The connector is configured to connect an external device to a garment to enable communication between electronics embedded in the garment and the external device. The connector may include a connector plug and a connector receptacle. The connector plug may be implemented at the external device and is configured to connect to the connector receptacle, which may be implemented at the garment. In some cases, these roles may be reversed, such that the connector plug is implemented at the garment and the connector receptacle is implemented at the external device.

The connector plug may utilize a variety of different materials to form an electrical connection with the connector receptacle. In one or more implementations, the connector plug includes an anisotropic material that is configured to connect to a printed circuit board (PCB) implemented at the connector receptacle. For example, the connector plug, implemented at the external device, may include a first printed circuit board coupled to a strip of an anisotropic conducting polymer. The connector receptacle, implemented at the garment, may include a second printed circuit board that includes circular pads. The strip of anisotropic conducting polymer is configured to form a connection with the circular pads of the second printed circuit board to enable a connection between one or more electronic components of the external device and the electronics embedded in the garment.

In another implementation, the connector plug may include compliant polyurethane polymers to provide compliance to metal pads implemented at the connector receptacle to enable an electromagnetic connection. In another implementation, the connector plug and the connector receptacle may each include magnetically coupled coils which can be aligned to provide power and data transmission.

Unlike conventional connectors, the garment connectors described herein are easily integrated into fabrics, provide connectivity between the garment and the external device, provide multi-pin electrical connections and power transmission simultaneously, are washable and cleanable, are easily engaged and disengaged by the user, remain locked when desired, and are forgiving to rotation misalignments which often occur when wearing garments.

EXAMPLE ENVIRONMENT

FIG. 1 is an illustration of an example environment 100 in which a connector for connecting electronics embedded in garments to external devices can be implemented. Environment 100 includes a garment connector 102 ("connector 102") that is configured to connect an external device 104 to an interactive garment 106 ("garment 106"). Doing so enables communication (e.g., data transfer and power transfer) between electronics 108 embedded in garment 106 and external device 104.

Garment 106 may include various types of electronics 108, such as by way of example and not limitation, sensors (e.g., capacitive touch sensors woven or otherwise integrated into the garment, microphones, or accelerometers), output devices (e.g., LEDs, speakers, or micro-displays), electrical circuitry, and so forth. In environment 100, examples of garment 106 include a shirt 106-1, a hat 106-2, and a handbag 106-3. It is to be noted, however, that connector 102 can be configured to connect to any type of garment or flexible object made from fabric or a similar flexible material, such as articles of clothing, blankets, shower curtains, towels, sheets, bed spreads, or fabric casings of furniture, to name just a few.

External device 104 includes various electronic components 110 that are configured to connect and/or interface with electronics 108 of garment 106. Examples of electronic components 110 include batteries, microprocessors, wireless units (e.g., Bluetooth or WiFi), sensors (e.g., accelerometers, heart rate monitors, or pedometers), output devices (e.g., speakers, LEDs), and so forth.

In this example, external device 104 is implemented as a strap that contains the various electronic components 110. The strap, for example, can be formed from a material such as rubber, nylon, or any other type of fabric. Notably, however, external device 104 may take any type of form. For example, rather than being a strap, external device 104 could resemble a circular or square piece of material (e.g., rubber or nylon).

In this example, external device 104 further includes a USB plug 111 which may enable external device 104 to be connected to other devices, such as to connect external device 104 to a computer to charge the device or transfer data. However, in other implementations, external device 104 may be implemented without USB plug 111, or with a different type of connector.

Connector 102 includes a connector plug 112 and a connector receptacle 114. In this example, connector plug 112 is positioned on external device 104 and is configured to attach to connector receptacle 114, which is positioned on garment 106, to form an electronic connection between external device 104 and garment 106. For example, in FIG. 1, connector receptacle 114 is positioned on a sleeve of garment 106.

In various implementations, connector plug 112 may resemble a snap or button, and is configured to connect or attach to connector receptacle 114 via a magnetic or mechanical coupling. For example, in some implementations magnets on connector plug 112 and connector receptacle 114 cause a magnetic connection to form between connector plug 112 and connector receptacle 114. Alternately, a mechanical connection between these two components may cause the components to form a mechanical coupling, such as by "snapping" together.

Connector 102 may be implemented in a variety of different ways. In one or more implementations, connector plug 112 includes an anisotropic conducting polymer which is configured to connect to circular pads of a printed circuit board (PCB) implemented at connector receptacle 114. In another implementation, connector plug 112 may include compliant polyurethane polymers to provide compliance to metal pads implemented at connector receptacle 114 to enable an electromagnetic connection. In another implementation, connector plug 112 and connector receptacle 114 may each include magnetically coupled coils which can be aligned to provide power and data transmission.

Figure 2:
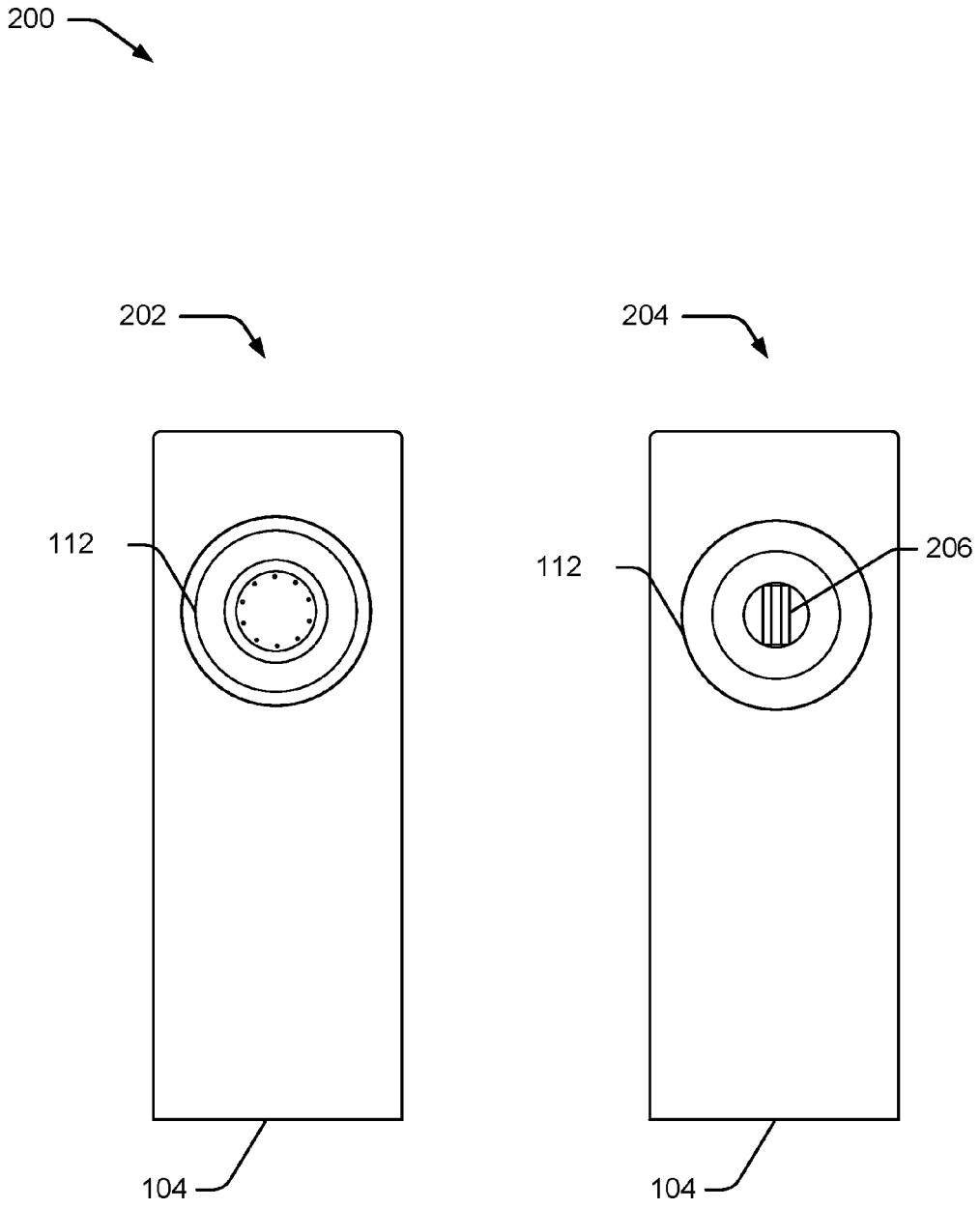
FIG. 2 illustrates an example of a garment connector when implemented with an anisotropic conducting polymer in accordance with one or more implementations.

FIG. 2 illustrates an example 200 of garment connector 102 when implemented with an anisotropic conducting polymer in accordance with one or more implementations.

At 202, a top side of connector plug 112 is shown. In this case, the top side of connector plug 112 resembles a round, button-like structure. Notably the top side of connector plug 112 may be implemented with various different shapes (e.g., square or triangular). Further, in some cases the top side of connector plug 112 may resemble something other than a button or snap.

In this example, the top side of connector plug 112 includes one or more openings (e.g., tiny holes) to enable light from one or more light sources (e.g., LEDs) to shine through. Of course, other types of input or output units could also be positioned here, such as a microphone or a speaker.

At 204, a bottom side of connector plug 112 is shown. The bottom side of connector plug 112 includes an anisotropic conducting polymer 206 to enable electrical connections between electronics 108 of interactive garment 106 and electronic components 110 of external device 104.

Figure 3:
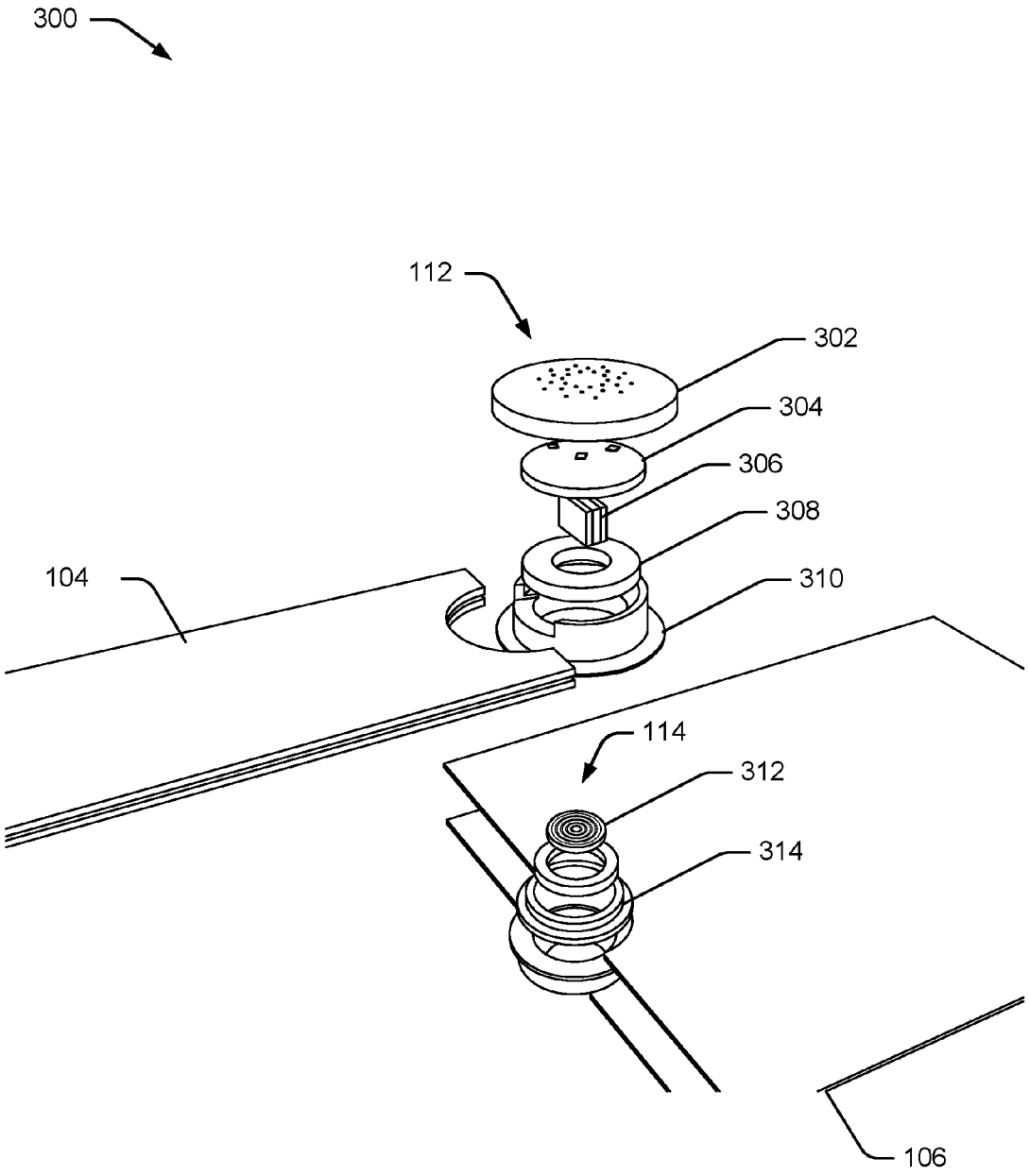
FIG. 3 illustrates an exploded view of a garment connector when implemented with an anisotropic conducting polymer in accordance with one or more implementations.

In more detail, consider FIG. 3 which illustrates an exploded view 300 of garment connector 102 when implemented with an anisotropic conducting polymer in accordance with one or more implementations.

In this example, connector plug 112 of connector 102 includes a button cap 302, a printed circuit board (PCB) 304, anisotropic conducting polymer 306, a magnet 308, and a casing 310.

Button cap 302 resembles a typical button, and may be made from a variety of different materials, such as plastic, metal, and so forth. In this example, button cap 302 includes holes which enable light from LEDs to shine through.

PCB 304 is configured to electrically connect electronics 108 of garment 106 to anisotropic conducting polymer 306. A top layer of PCB 304 may include the LEDs that shine through the holes in button cap 302. A bottom layer of PCB 304 includes contacts which electrically connect to anisotropic conducting polymer 306 positioned beneath PCB 304.

Anisotropic conducting polymer 306 includes a strip of anisotropic material that is configured to form a connection with connector receptacle 114. The anisotropic material include any type of anisotropic material.

Magnet 308 is configured to enable a magnetic connection to connector receptacle 114. The magnetic connection enables connector plug 112 to attach to connector receptacle 114 without the need to apply force to connect, which reduces the chance of the connection wearing down over time. Alternately, in one or more implementations, connector plug 112 may be implemented without magnet 308. For example, connector plug 112 could be implemented as physical or mechanical snap that snaps to connector receptacle 114. Casing 310 is configured to hold the components of connector plug 112, and can be implemented from a variety of different materials such as plastic, metal, and so forth.

In this example, connector receptacle 114 includes a receptacle PCB 312 which includes circular pads which are configured to connect to anisotropic conducting polymer 306. The bottom layer of receptacle PCB 312 includes connections to electronics 108 of garment 106.

Connector receptacle may also include a metallic component 314 which is configured to generate a magnetic force with magnet 308 of connector plug 112 to form the magnetic connection between connector plug 112 and connector receptacle 114. Metallic component 314 may be implemented as any type of metal or alloy, or as another magnet, that can generate a magnetic force with magnet 308. Connector receptacle 114 may also include other components, such as a housing, a washer, and so forth.

Notably, anisotropic conducting polymer 306 includes various properties which make for a good connector, which include rotational tolerance, mechanical compliance, multi-pin electrical and power transmission, and being waterproof.

For instance, when connector plug 112 attaches to connector receptacle 114, an electrical connection is formed between anisotropic conducting polymer 306 and receptacle PCB 312. The anisotropic conducting polymer 306 provides rotational tolerance because the strip of anisotropic material can be rotated 360 degrees and maintain the same connection to the circular pads of receptacle PCB 312. This is beneficial because when wearing a garment, the strap of external device 104 will naturally move around. Thus, the rotational tolerance enables the connector to be rotated without losing the connection between connector plug 112 and connector receptacle 114. Furthermore, the anisotropic conducting polymer 306 is elastomeric, which causes the strip of material to shrink and conform under mechanical force.

Anisotropic conducting polymer 306 provides multi-pin electrical transmissions and power transfer transmissions simultaneously. For example, the anisotropic material causes conduction to occur in just one direction, which means that the conductive paths can operate completely independently, without interfering with each other. This enables multiple conducting channels, which makes it easy to isolate multiple data lines or power lines from each other using anisotropic conducting polymer 306 and the circular structure of receptacle PCB 312.

Additionally, anisotropic conducting polymer 306 is waterproof which prevents connector 102 from being damaged by water, such as when being worn in the rain or when being washed.

Connector 102 may be implemented in a variety of different ways. In one or more implementations, instead of using anisotropic conducting polymer 306, connector plug 112 may include compliant polyurethane polymers to provide compliance to metal pads implemented at connector receptacle 114 to enable an electromagnetic connection. In another implementation, connector plug 112 and connector receptacle 114 may each include magnetically coupled coils which can be aligned to provide power and data transmission between garment 106 and external device 104.

EXAMPLE COMPUTING SYSTEM

Figure 4:
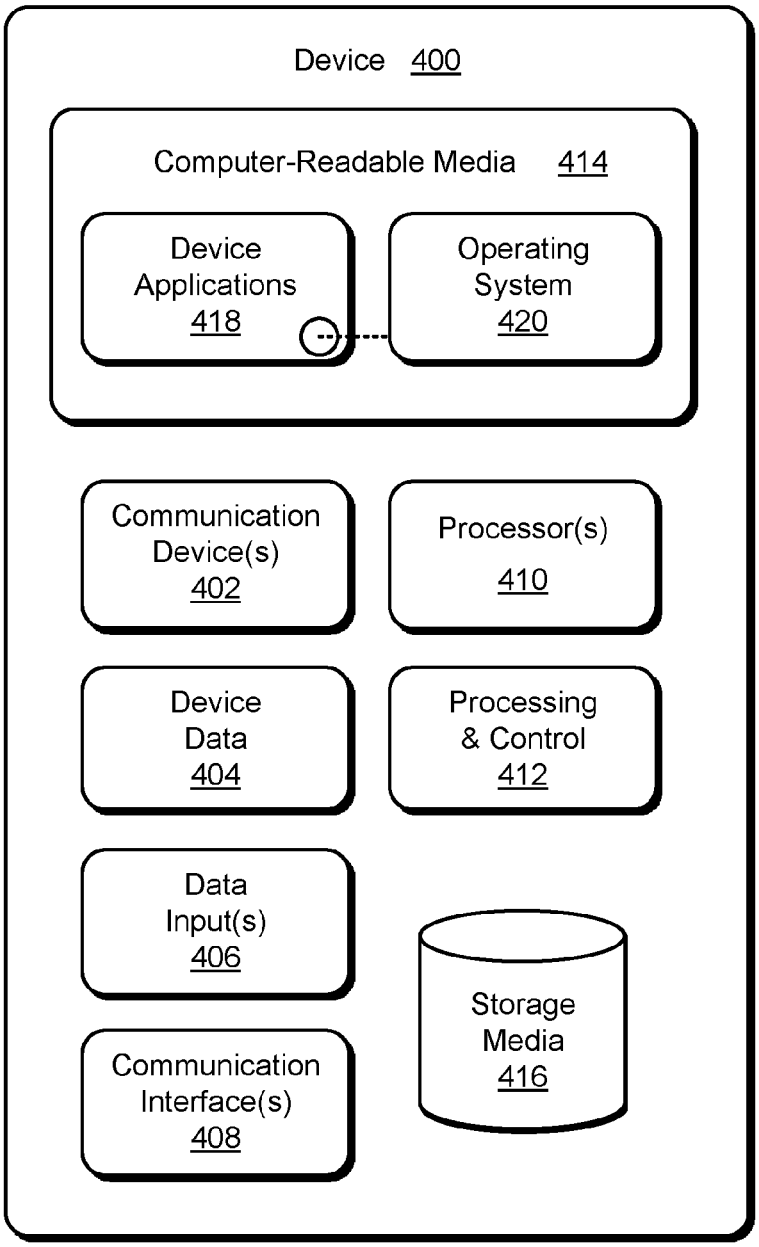
FIG. 4 illustrates various components of an example computing system that can be implemented as any type of client, server, and/or computing device as described with reference to the previous FIGS. 1-3 to implement connectors for connecting electronics embedded in garments to external devices.

FIG. 4 illustrates various components of an example computing system 400 that can be implemented as any type of client, server, and/or computing device as described with reference to the previous FIGS. 1-3 to implement connectors for connecting electronics embedded in garments to external devices. For example, computing system 400 may correspond to external device 104 and/or embedded in garment 106. In embodiments, computing system 400 can be implemented as one or a combination of a wired and/or wireless wearable device, System-on-Chip (SoC), and/or as another type of device or portion thereof. Computing system 400 may also be associated with a user (e.g., a person) and/or an entity that operates the device such that a device describes logical devices that include users, software, firmware, and/or a combination of devices.

Computing system 400 includes communication devices 402 that enable wired and/or wireless communication of device data 404 (e.g., received data, data that is being received, data scheduled for broadcast, data packets of the data, etc.). Device data 404 or other device content can include configuration settings of the device, media content stored on the device, and/or information associated with a user of the device. Media content stored on computing system 400 can include any type of audio, video, and/or image data. Computing system 400 includes one or more data inputs 406 via which any type of data, media content, and/or inputs can be received, such as human utterances, user-selectable inputs (explicit or implicit), messages, music, television media content, recorded video content, and any other type of audio, video, and/or image data received from any content and/or data source.

Computing system 400 also includes communication interfaces 408, which can be implemented as any one or more of a serial and/or parallel interface, a wireless interface, any type of network interface, a modem, and as any other type of communication interface. Communication interfaces 408 provide a connection and/or communication links between computing system 400 and a communication network by which other electronic, computing, and communication devices communicate data with computing system 400.

Computing system 400 includes one or more processors 410 (e.g., any of microprocessors, controllers, and the like), which process various computer-executable instructions to control the operation of computing system 400 and to enable techniques for, or in which can be embodied, interactive textiles. Alternatively or in addition, computing system 400 can be implemented with any one or combination of hardware, firmware, or fixed logic circuitry that is implemented in connection with processing and control circuits which are generally identified at 412. Although not shown, computing system 400 can include a system bus or data transfer system that couples the various components within the device. A system bus can include any one or combination of different bus structures, such as a memory bus or memory controller, a peripheral bus, a universal serial bus, and/or a processor or local bus that utilizes any of a variety of bus architectures.

Computing system 400 also includes computer-readable media 414, such as one or more memory devices that enable persistent and/or non-transitory data storage (i.e., in contrast to mere signal transmission), examples of which include random access memory (RAM), non-volatile memory (e.g., any one or more of a read-only memory (ROM), flash memory, EPROM, EEPROM, etc.), and a disk storage device. A disk storage device may be implemented as any type of magnetic or optical storage device, such as a hard disk drive, a recordable and/or rewriteable compact disc (CD), any type of a digital versatile disc (DVD), and the like. Computing system 400 can also include a mass storage media device 416.

Computer-readable media 414 provides data storage mechanisms to store device data 404, as well as various device applications 418 and any other types of information and/or data related to operational aspects of computing system 400. For example, an operating system 420 can be maintained as a computer application with computer-readable media 414 and executed on processors 410. Device applications 418 may include a device manager, such as any form of a control application, software application, signal-processing and control module, code that is native to a particular device, a hardware abstraction layer for a particular device, and so on. Device applications 418 also include any system components, engines, or managers to implement connectors for connecting electronics embedded in garments to external devices.

CONCLUSION

Although embodiments of techniques using, and objects including, connectors for connecting electronics embedded in garments to external devices have been described in language specific to features and/or methods, it is to be understood that the subject of the appended claims is not necessarily limited to the specific features or methods described. Rather, the specific features and methods are disclosed as example implementations of connectors for connecting electronics embedded in garments to external devices.

What is claimed is:

1. A connector for connecting electronics embedded in a garment to an external device, the connector comprising:

a connector plug implemented at the external device, the connector plug comprising a first printed circuit board coupled to a strip of an anisotropic conducting polymer having a linear configuration and being;

a connector receptacle implemented at the garment, the connector receptacle comprising a second printed circuit board comprising circular pads; and the strip of anisotropic conducting polymer configured to form a connection with the circular pads of the second printed circuit board to enable a connection between one or more electronic components of the external device and the electronics embedded in the garment.

2. The connector of claim 1, wherein the connector plug further comprises a magnet configured to form a magnetic connection with the connector receptacle.

3. The connector of claim 1, wherein the connector plug is configured to form a snap connection with the connector receptacle.

4. The connector of claim 1, wherein the one or more electronic components of the external device comprises one or more sensors, output devices, batteries, or wireless units.

5. The connector of claim 1, wherein the connector plug resembles a snap or a button.

6. The connector of claim 1, wherein the connector plug further comprises one or more light sources, and wherein a top side of the connector plug includes one or more openings to enable light from the one or more light sources to shine through the openings.

7. The connector of claim 1, wherein the strip of anisotropic conducting polymer provides rotational tolerance such that the strip of anisotropic conducting polymer can be rotated 360 degrees while maintaining the connection to the circular pads of the connector receptacle.

8. The connector of claim 1, wherein the anisotropic conducting polymer is waterproof.

9. The connector of claim 1, wherein the anisotropic conducting polymer provides multi-pin electrical transmissions and power transfer transmissions simultaneously.

10. The connector of claim 1, wherein the connector receptacle includes one or more magnetically coupled coils which can be aligned with one or more additional magnetically coupled coils of the connector plug to provide power and data transmission between the garment and the external device.

11. The connector of claim 1, wherein the strip of anisotropic conducting polymer is disposed within a center area of a ring-shaped magnet that is configured to form a magnetic connection with a metallic component of the connector receptacle.

12. An external device, comprising:

a strap containing one or more electronic components; and a connector plug configured to connect to a connector receptacle implemented at a garment to enable communication between the electronic components of the external device and electronics embedded in the garment, the connector plug including a first printed circuit board coupled to a strip of anisotropic conducting polymer having a linear configuration and being, the strip of anisotropic conducting polymer configured to form a connection with circular pads of a second printed circuit board implemented at the garment to enable a connection between the one or more electronic components of the external device and the electronics embedded in the garment.

13. The device of claim 12, wherein the connector plug further comprises a magnet configured to form a magnetic connection with the connector receptacle.

14. The device of claim 12, wherein the connector plug is configured to form a snap connection with the connector receptacle.

15. The device of claim 12, wherein the one or more electronic components of the external device comprises one or more sensors, output devices, batteries, or wireless units.

16. The external device of claim 12, wherein the pads comprise circular pads, and the strip of anisotropic conducting polymer provides rotational tolerance effective to enable the strip of anisotropic conducting polymer to be rotated while maintaining the connection to the circular pads of the connector receptacle.

17. The external device of claim 12, wherein the connector plug further comprises one or more light sources, and wherein a top side of the connector plug includes one or more openings to enable light from the one or more light sources to shine through the one or more openings.

18. The external device of claim 12, wherein the strip of anisotropic conducting polymer is disposed within a center area of a ring-shaped magnet.

19. The external device of claim 12, wherein the connector plug resembles a snap or a button.

20. The external device of claim 12, wherein the anisotropic conducting polymer provides multi-pin electrical transmissions and power transfer transmissions simultaneously.

* * * * *